US006298809B1

(12) United States Patent
Boggs

(10) Patent No.: US 6,298,809 B1
(45) Date of Patent: Oct. 9, 2001

(54) EMERGENCY COOLING AND REFILLING SYSTEM

(76) Inventor: Clayton F Boggs, 380 Country Road 558, Rogersville, AL (US) 35652

( * ) Notice: Subject to any disclaimer, the term of this patent is extended or adjusted under 35 U.S.C. 154(b) by 0 days.

(21) Appl. No.: 09/650,233

(22) Filed: Aug. 29, 2000

(51) Int. Cl.[7] ..... F01P 5/14
(52) U.S. Cl. ..... 123/41.15; 123/41.01
(58) Field of Search ..... 123/41.01, 41.55, 123/41.15

(56) References Cited

U.S. PATENT DOCUMENTS 4,461,342 * 7/1984 Avrea ..... 123/41.54
5,101,775 * 4/1992 Hubbs ..... 123/41.01

* cited by examiner

*Primary Examiner*—Noah P. Kamen
(74) *Attorney, Agent, or Firm*—Michael I. Kroll

(57) ABSTRACT

The present invention 10 discloses an emergency cooling and refilling system that can be adapted to fit any application involving a heat exchanger, such as an automobile radiator 32, transmission cooler 36, or air conditioner condenser coil 34 or residential and commercial central air condenser coils 64. The present invention 10 can be factory installed or retrofitted to existing units and is automatically activated when a thermocouple 20 detects a high temperature condition and activates a pump 24 that moves fluid 16 from an independent reservoir 22 to atomizers 28 facing the component to be cooled and sprayed thereupon. The atomized spray 30 takes on a spiraling nature due to the presence of a rotational nozzle 86 within the atomizer 28 that is acted upon by the passage of the pressurized fluid traveling through multiple diagonal channels 94 cut in the nozzle's head 78. The present invention 10 also provides a means for a vehicle operator to replace radiator fluid with fluid 16 from the independent reservoir 22 simply by activating a switch 56 in an accessible panel that monitors and controls operation of the emergency system. A fill sensor 54 located within the radiator 32 will detect when the desired amount of fluid 16 has been introduced to the cooling system and will automatically discontinue operation.

16 Claims, 12 Drawing Sheets

EMERGENCY COOLING AND REFILLING SYSTEM

BACKGROUND OF THE INVENTION

1. Field of the Invention

The present invention relates generally to automotive cooling systems and, more specifically, to an automatic emergency cooling and refilling system which detects when the temperature in a vehicle's cooling system rises above a selected level and automatically activates an atomized spray over the face of the radiator to prevent the engine from overheating thereby allowing an operator to continue driving uninterrupted to a desirable location. Previously an overheated condition could strand a vehicle in a hazardous or threatening location and could require road service or having the motorist leave the vehicle in search of water or a telephone.

2. Description of the Prior Art

There are numerous engine cooling systems for vehicles. While these cooling systems for vehicles may be suitable for the purposes for which they were designed, they would not be as suitable for the purposes of the present invention as heretofore described. It is thus desirable to provide an emergency cooling and refilling system that can be adapted to fit any application involving a heat exchanger, such as an automobile radiator and transmission cooler/air conditioner condenser coil or residential and commercial central air condenser coils. The present invention can be factory installed or retrofit to existing units and is automatically activated when a thermocouple detects a high temperature condition and activates a pump that moves fluid from an independent reservoir to atomizers facing the component to be cooled and sprayed thereupon. The atomized spray takes on a spiraling nature due to the presence of a rotational nozzle within atomizer that is acted upon by the passage of the pressurized fluid traveling through diagonal channels cut in the nozzle's head. The present invention also provides a means for a vehicle operator to replace radiator fluid with fluid from the independent reservoir simply by activating a switch in an accessible panel that monitors and controls operation of the emergency system. A fill sensor located within the radiator will detect when the desired amount of fluid has been introduced to the cooling system and will automatically discontinue operation.

SUMMARY OF THE PRESENT INVENTION

The present invention relates generally to cooling systems for vehicles and, more specifically, to an emergency cooling and refilling system for motor vehicles, air conditioning systems and other heat exchanger applications wherein said system is automatically initiated when a high temperature condition is detected by a thermocouple communicating with the cooling system of the apparatus being maintained. Fluid is then transferred from an independent reservoir through a pump and into a conduit where it is pressurized. The conduit contains a plurality of atomizers strategically placed to provide a means of egress for the pressurized fluid during atomization and the resulting spray is ejected upon the object to be cooled such as a radiator or condensing coil. The emission from the atomizer takes on a rotational effect due to the properties of a free-spinning rotational nozzle within the atomizer. The atomizer has a threaded two-piece housing with a central recess and inlet conduit extending longitudinally therethrough and said inlet conduit leads to a fluid inlet recess situated within the interior portion of the conduit and an egress recess on a distal end of the atomizer and in an exterior region of the conduit facing the component to be cooled thereby providing a passageway through which fluid can travel. The central recess houses the atomization components comprising a spring loaded ball-type check valve and an atomizing rotational nozzle having a cylindrical nozzle head and a shank being of sufficient diameter to nestle inside the spring without restricting the potential for the axial rotation of the nozzle. When the atomizer is assembled the nozzle head is placed against the egress recess of the housing with the shank residing within a first end of the spring and the ball of the check valve held in place against the inlet conduit by a second end of said spring. The spring exerts an opposing bias to the nozzle and to the check ball. Fluid enters the atomizer through the inlet recess, passes through the inlet conduit where the flow into the central recess is restricted by the ball of the check valve which is of a greater diameter than the inlet conduit until the pressure within the conduit is greater than the bias presented by the spring resulting in the ball moving away from the inlet recess and compressing the spring thereby increasing the bias applied to the nozzle against the egress portion of the housing. Diagonally cut channels extend from the upper side portion of the nozzle head to the top thereof providing the only path for the pressurized fluid to travel from the central recess to the egress recess. The pressure of the fluid passing through the channels causes the propeller-like axial rotation of the nozzle head resulting in a spiraling, atomized spray.

A primary object of the present invention is to provide an emergency cooling and refilling system for vehicles capable of detecting a high temperature condition and automatically applying an atomized spray to the radiator to prevent the engine from overheating and possibly damaging or disabling the vehicle.

Another object of the present invention is to provide an emergency cooling and refilling system for vehicles capable of refilling the vehicle's radiator with fluid from an independent reservoir when the radiator is in a low fluid condition.

Still another object of the present invention is to provide an emergency cooling and refilling system to be utilized with heat exchanger applications such as central air conditioning.

A further object of the present invention is to provide an emergency cooling and refilling system that could be factory installed or easily retrofit to existing units.

A still further object of the present invention is to provide an emergency cooling and refilling system that when applied to a vehicle has a control panel inside the cab to allow the driver to monitor the system's status and to enable him to control functions manually or automatically.

A yet further object of the present invention is to provide an emergency cooling and refilling system having a thermocouple device to detect when the temperature in vehicle's cooling system exceeds a predetermined level and communicates to the system the need to initiate operation.

Another object of the present invention is to provide an emergency cooling and refilling system having a three way electrically operated valve on the pump's discharge line to transfer flow between the atomization conduit and the emergency refill conduit.

Yet another object of the present invention is to provide an emergency cooling and refilling system having a solenoid valve that is acted upon by the thermocouple device and activates the pump.

Still another object of the present invention is to provide an emergency cooling and refilling system having a plurality of atomizers.

A further object of the present invention is to provide an emergency cooling and refilling system wherein each atomizer has an internal rotational nozzle and a spring loaded check valve with said spring exerting an opposing bias to the nozzle and the check ball.

A still further object of the present invention is to provide an emergency cooling and refilling system wherein each nozzle head has a plurality of diagonal channels cut into the upper portion thereof providing a passage for pressurized fluid flow from the side of the nozzle head to the top resulting in atomization of the fluid and the axial rotation of the nozzle as the fluid passes therethrough providing greater force in the ejection of the atomized spray Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
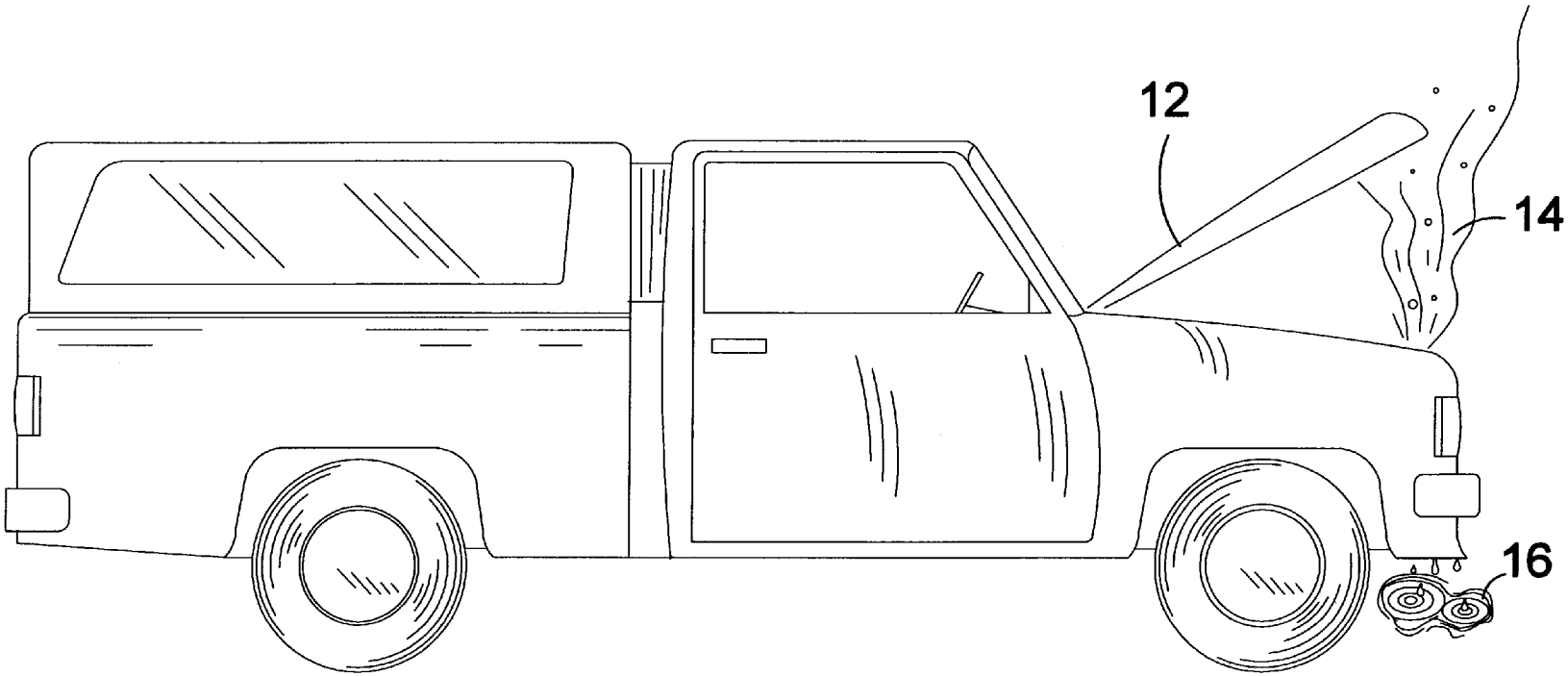
FIG. 1 is side view of the prior art showing a truck that has overheated and rendered disabled.

With regard to reference numerals used, the following numbering is used throughout the drawings.

10 present invention
12 vehicle
14 steam
16 fluid/coolant
18 direction arrow
20 thermocouple
22 reservoir
24 pump
26 conduit
28 atomizer
30 spray
32 first radiator
34 air conditioner condenser coil
36 transmission cooler
38 direction arrow
40 conduit
42 3-way valve
44 emergency refill conduit
46 check valve
48 solenoid
50 thermostat
52 second radiator
54 fill sensor
56 3-position switch
58 manual
60 automatic
62 refill
64 central A/C coil
66 local water supply
68 direction arrow
70 outlet aperture
74 filtration screen
76 inlet aperture
78 nozzle head
80 central recess
82 spring
84 ball
86 nozzle
88 nozzle shank
90 first housing
92 second housing
94 channels

DESCRIPTION OF THE PREFERRED EMBODIMENT(S)

In order that the invention may be more fully understood, it will now be described, by way of example, with reference to the accompanying drawings in which FIGS. 1 through 12 illustrate the present invention being an emergency cooling and refilling system Turning to FIG. 1, shown therein is side view of the prior art showing a truck vehicle 12 that has overheated and rendered disabled. Shown is steam 14 and coolant fluid 16 from the truck vehicle 12. The present invention discloses a cooling system for vehicles 12 and, more specifically, an emergency cooling and refilling system for motor vehicles 12, air conditioning systems and other heat exchanger applications.

Figure 2:
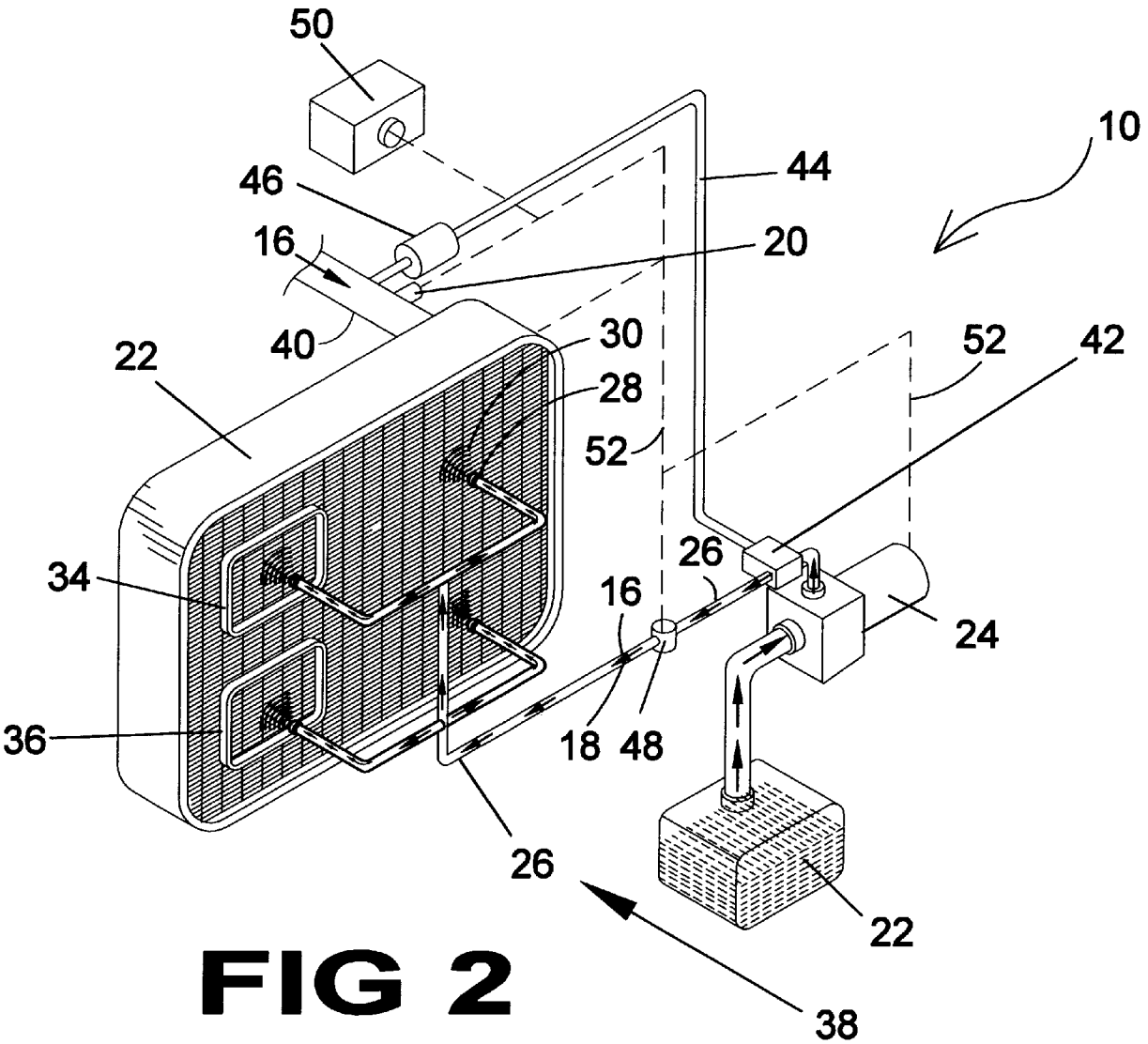
FIG. 2 is a perspective diagrammatic view showing the components of the present invention and the flow of fluid therein during operation.

Turning to FIG. 2, shown therein is a perspective diagrammatic view showing the components of the present invention 10 and the flow of fluid 16 shown by direction arrows 18 therein during operation. The present invention 10 discloses a cooling system for vehicles and, more specifically, an emergency cooling and refilling system for motor vehicles, air conditioning systems and other heat exchanger applications wherein the system is automatically initiated when a high temperature condition is detected by a thermocouple 20 communicating with the cooling system of the apparatus being maintained. Fluid 16 is then transferred from an independent reservoir 22 through a pump 24 and into an atomization conduit 26 where it is pressurized. The conduit 26 contains a plurality of atomizers 28 strategically placed to provide a spray 30 of fluid 16 which is ejected onto the object to be cooled such as a radiator 32, air conditioning condenser coil 34 or transmission cooler 36. Also shown is a direction arrow 38 indicating the direction of air flow toward the radiation 32. Also shown is the coolant conduit 40 carrying cooling fluid 16 from the engine to the radiator. A 3-way electrically operated control valve 42 is shown connected by an emergency refill conduit 44 to conduit 40 having a check valve 46 therein. A solenoid valve 48 is shown in conduit 18 being electrically connected 52 to thermocouple 20, thermostat 50 for controlling the set point temperature and pump 24.

Figure 3:
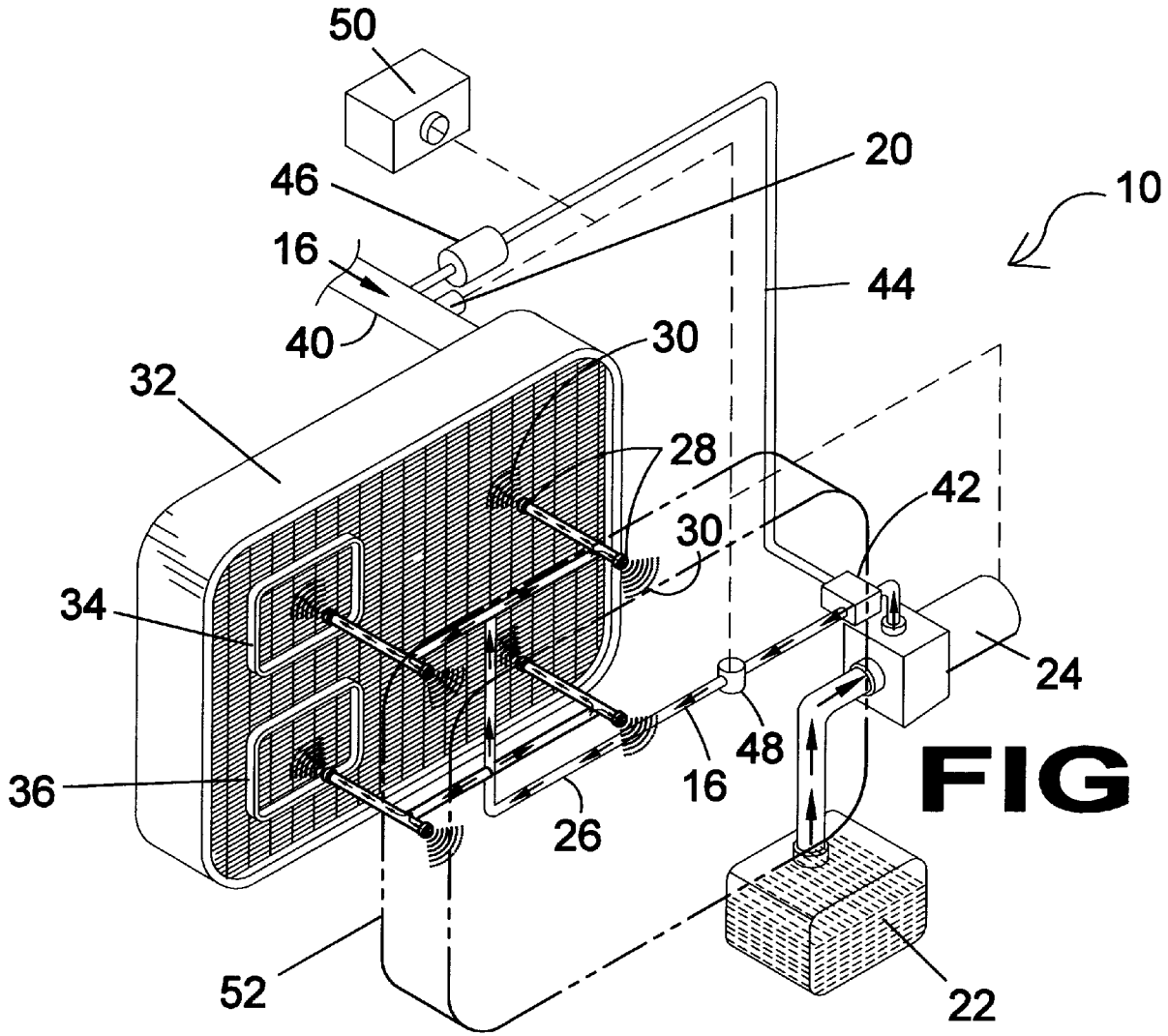
FIG. 3 is a perspective diagrammatic view showing the components of the present invention and the flow of fluid therein with a cooling system using a dual radiator configuration.

Turning to FIG. 3, shown therein is a perspective diagrammatic view showing the components of the present invention 10 and the flow of fluid 16 therein with a cooling system using a dual radiator configuration. The elements of this embodiment are similar to those previously disclosed. In this embodiment the atomization conduit terminates into multiple, e.g., eight, atomizers 28 positioned to provide spray 30 onto the pair of radiators 32, 52.

Figure 4:
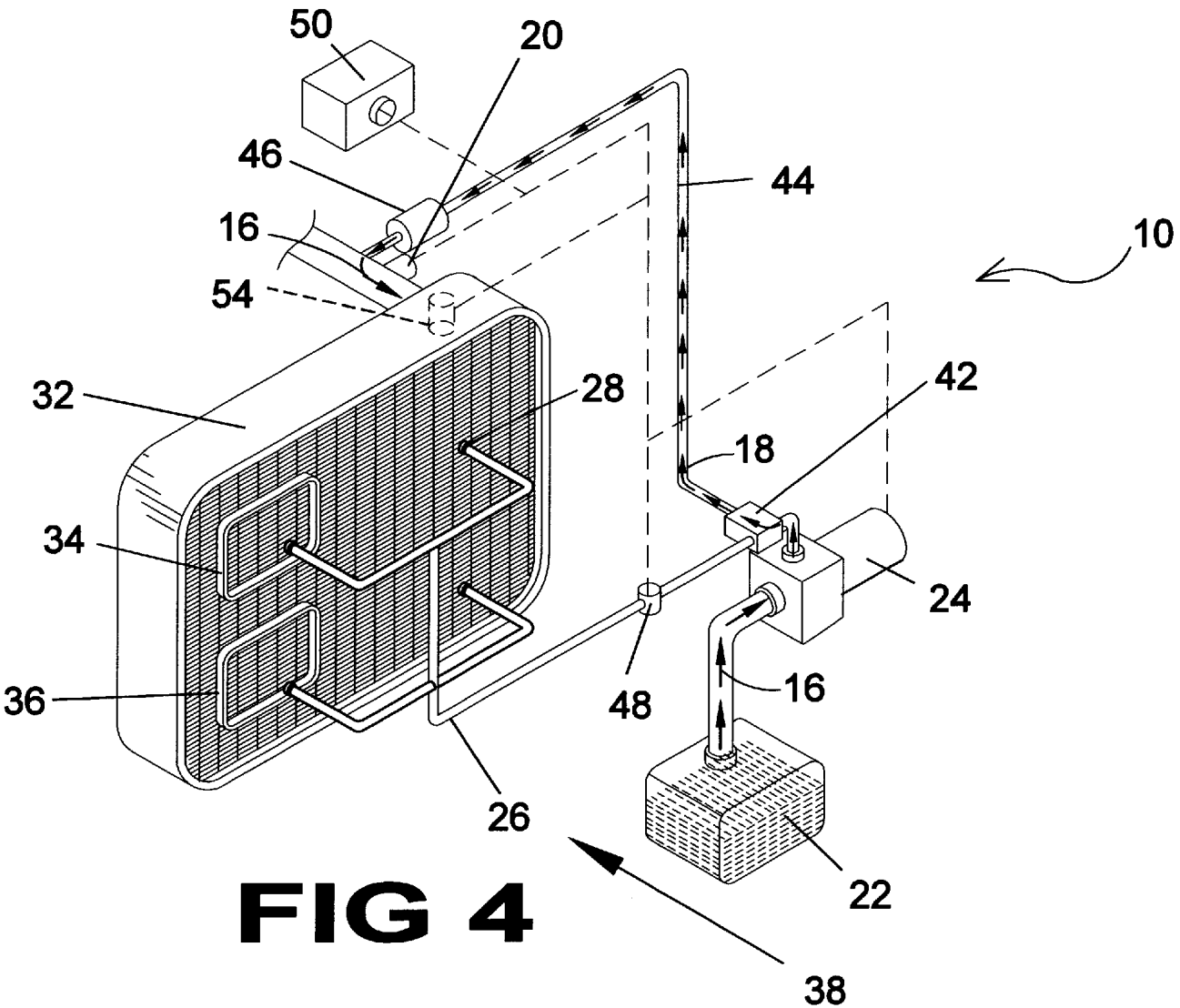
FIG. 4 is a perspective diagrammatic view showing the components of the present invention and the flow of fluid therein during refilling of the radiator.

Turning to FIG. 4, shown therein is a perspective diagrammatic view showing the components of the present invention 10 and the flow of fluid 16 therein during refilling of the radiator 32. The elements of this embodiment are similar to those previously disclosed. The present invention 10 also provides a means for a vehicle operator to replace radiator fluid with fluid 16 from the independent reservoir 22 simply by activating a switch (not shown, but see FIG. 5) proximately disposed to the operator in an accessible panel that monitors and controls operation of the emergency system. Fluid 16 flow is redirected by a 3-way valve 42 to refill the radiation as indicated by arrow 18. A fill sensor 54 located within the radiator 32 will detect when the desired amount of fluid 16 has been introduced to the cooling system and will automatically discontinue operation.

Figure 5:
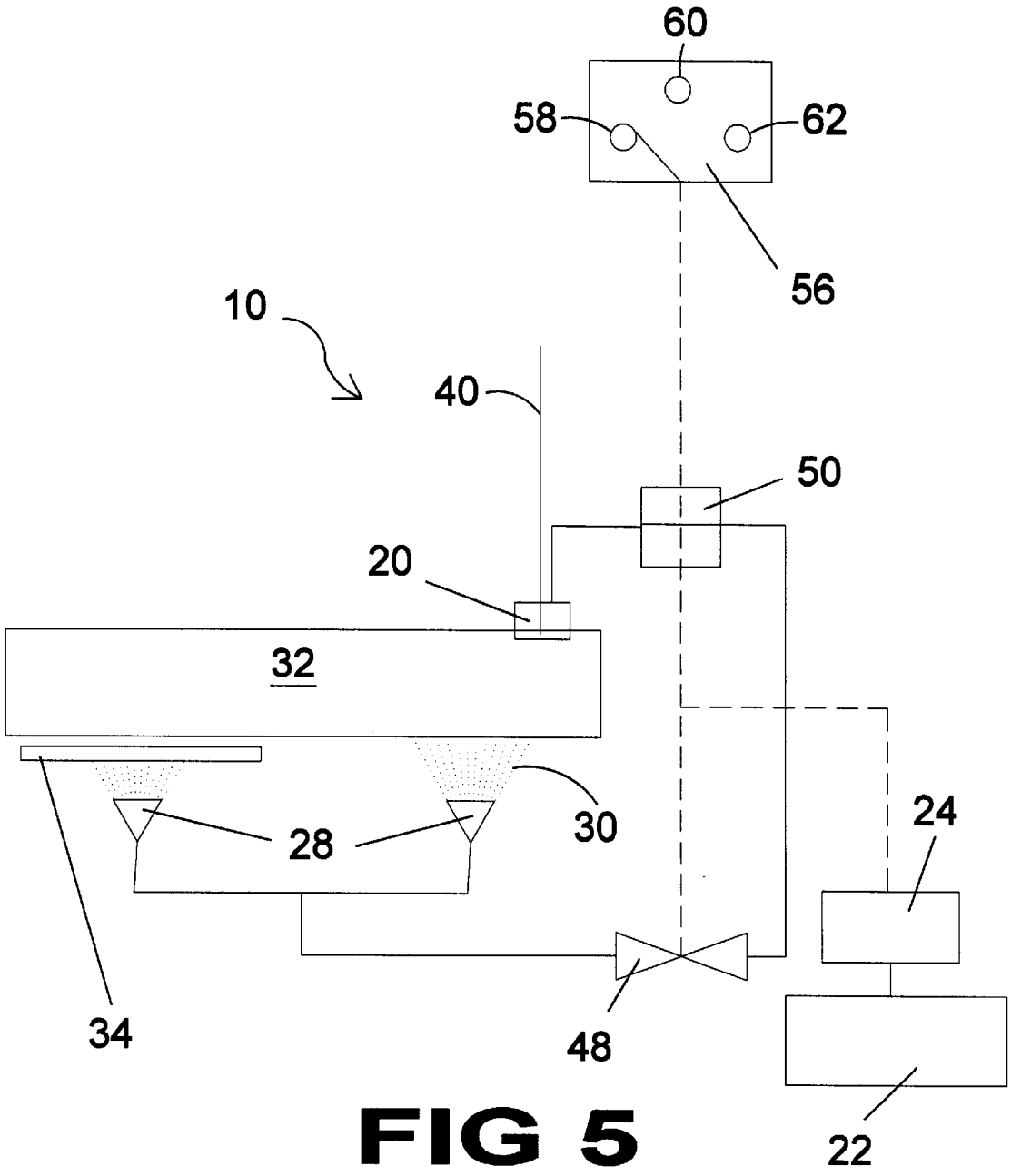
FIG. 5 is a block diagram depicting the interaction and relationship of the various components of the present invention as applied to a vehicle.

Turning to FIG. 5, shown therein is a block diagram depicting the interaction and relationship of the various components of the present invention 10 as applied to a vehicle. Also shown is a 3-position switch 56 having a manual 58, automatic 60, and a refill 62 position.

Figure 6:
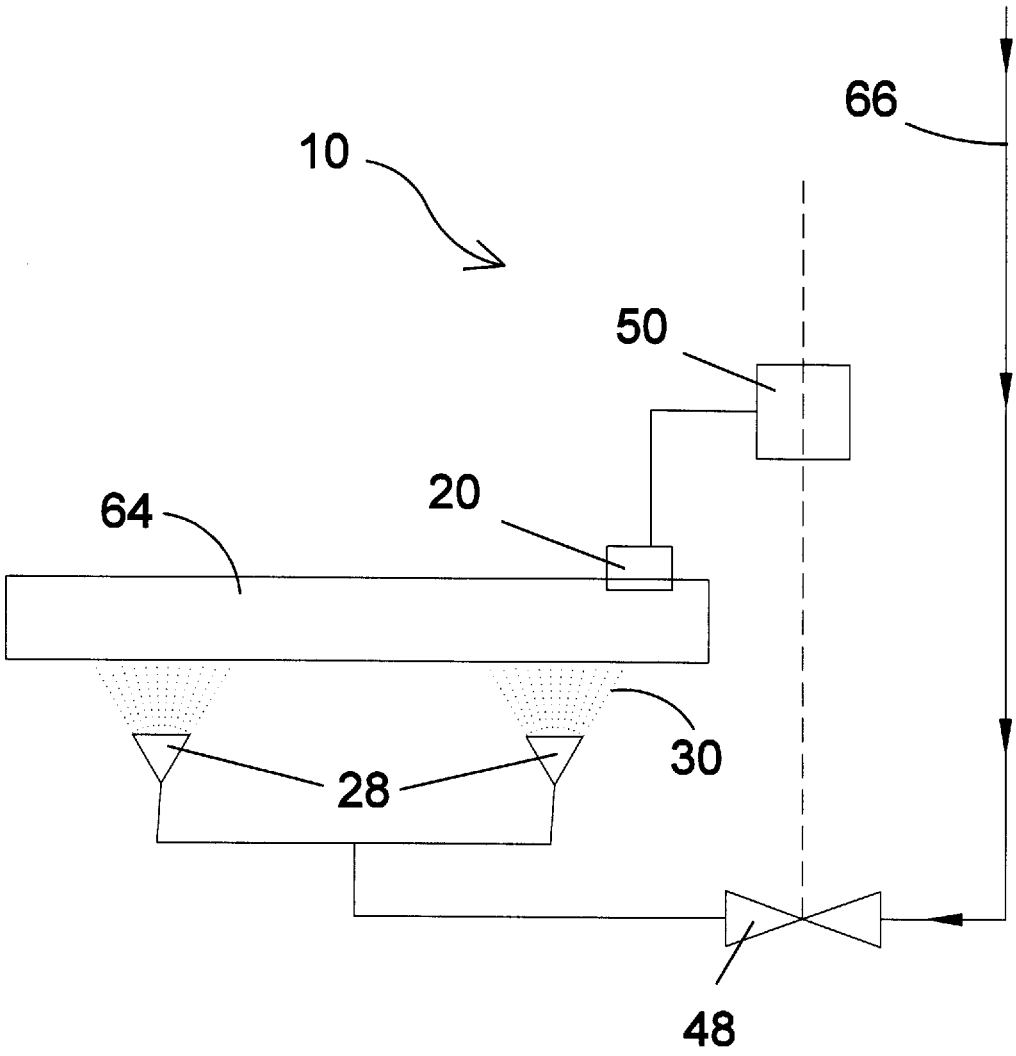
FIG. 6 is a block diagram depicting the interaction and relationship of the various components of the present invention as applied to a central air conditioning unit.

Turning to FIG. 6, shown therein is a block diagram depicting the interaction and relationship of the various components of the present invention 10 as applied to a central air conditioning unit 64 or air condensing coil. Elements previously disclosed are shown along with a local water supply 66 which serves as the source of the cooling fluid spray 30.

Figure 7:
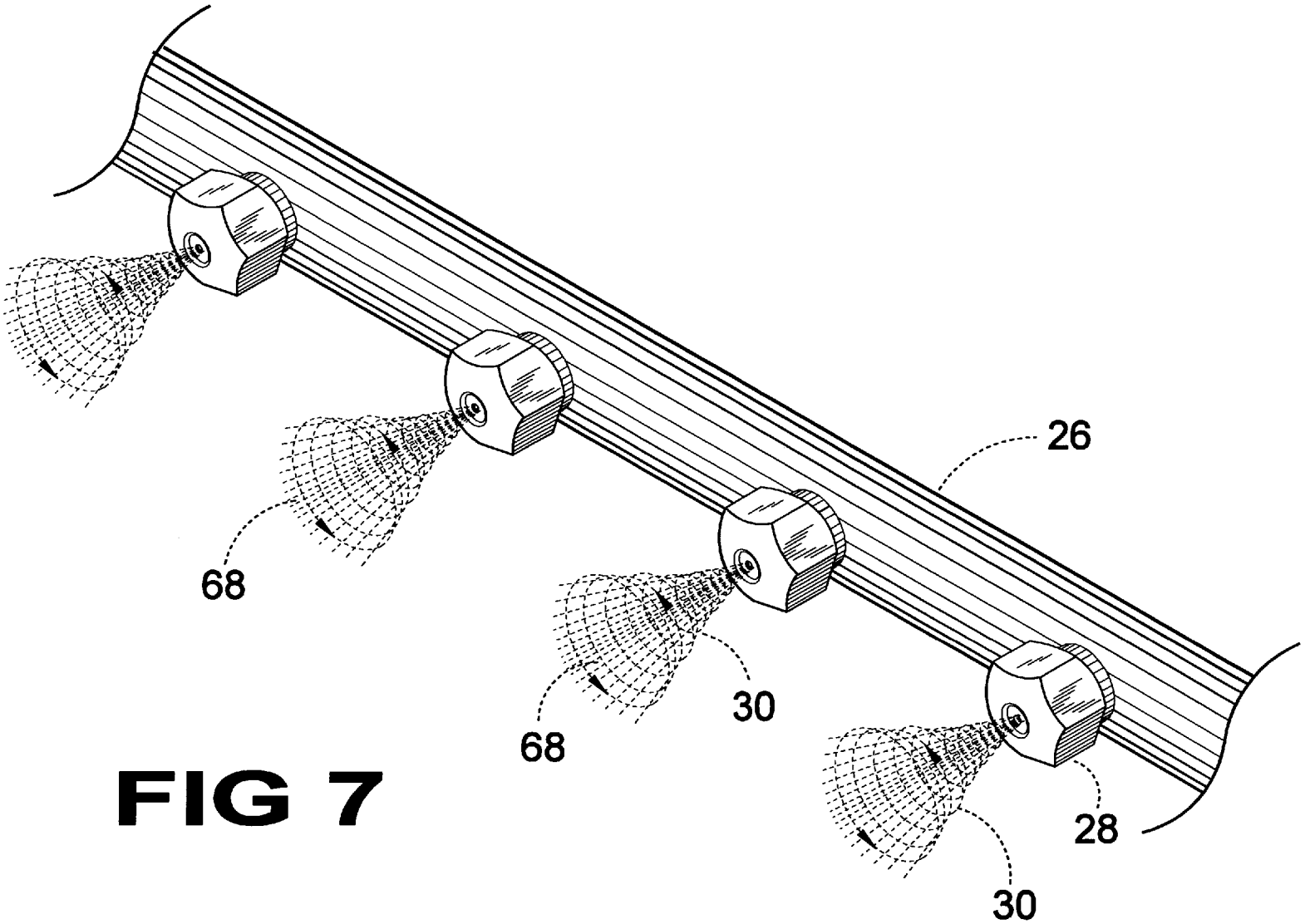
FIG. 7 is a perspective view showing a plurality of atomizers installed in series and activated.

Turning to FIG. 7, shown therein is a perspective view showing a plurality of atomizers 28 installed in series in a conduit 26 and activated. Direction arrows 68 indicate the rotation direction of atomized spray 30 caused by the unique design of the atomizers 28.

Figure 8:
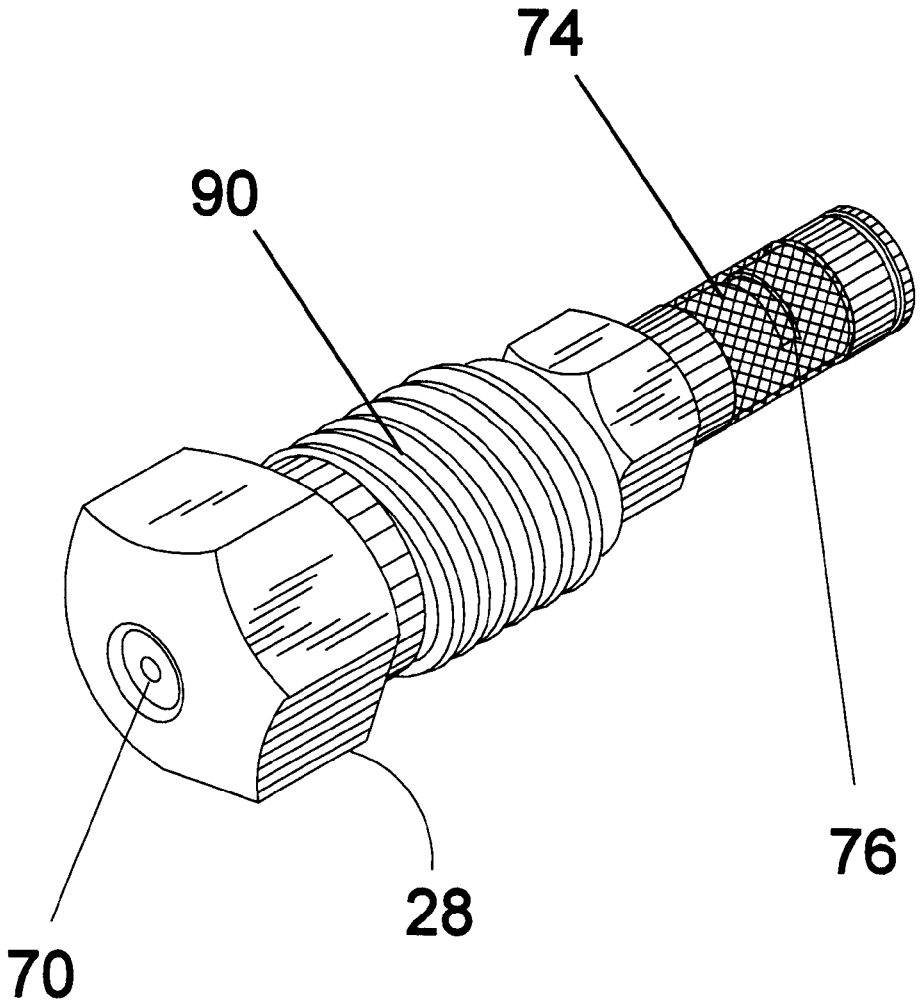
FIG. 8 is a perspective view of an atomizer.

Turning to FIG. 8, shown therein is a perspective view of an atomizer 28. Shown is the fluid egress recess or outlet aperture 70 along with the housing 90, filtration screen 74 and inlet recess or aperture 76.

Figure 9:
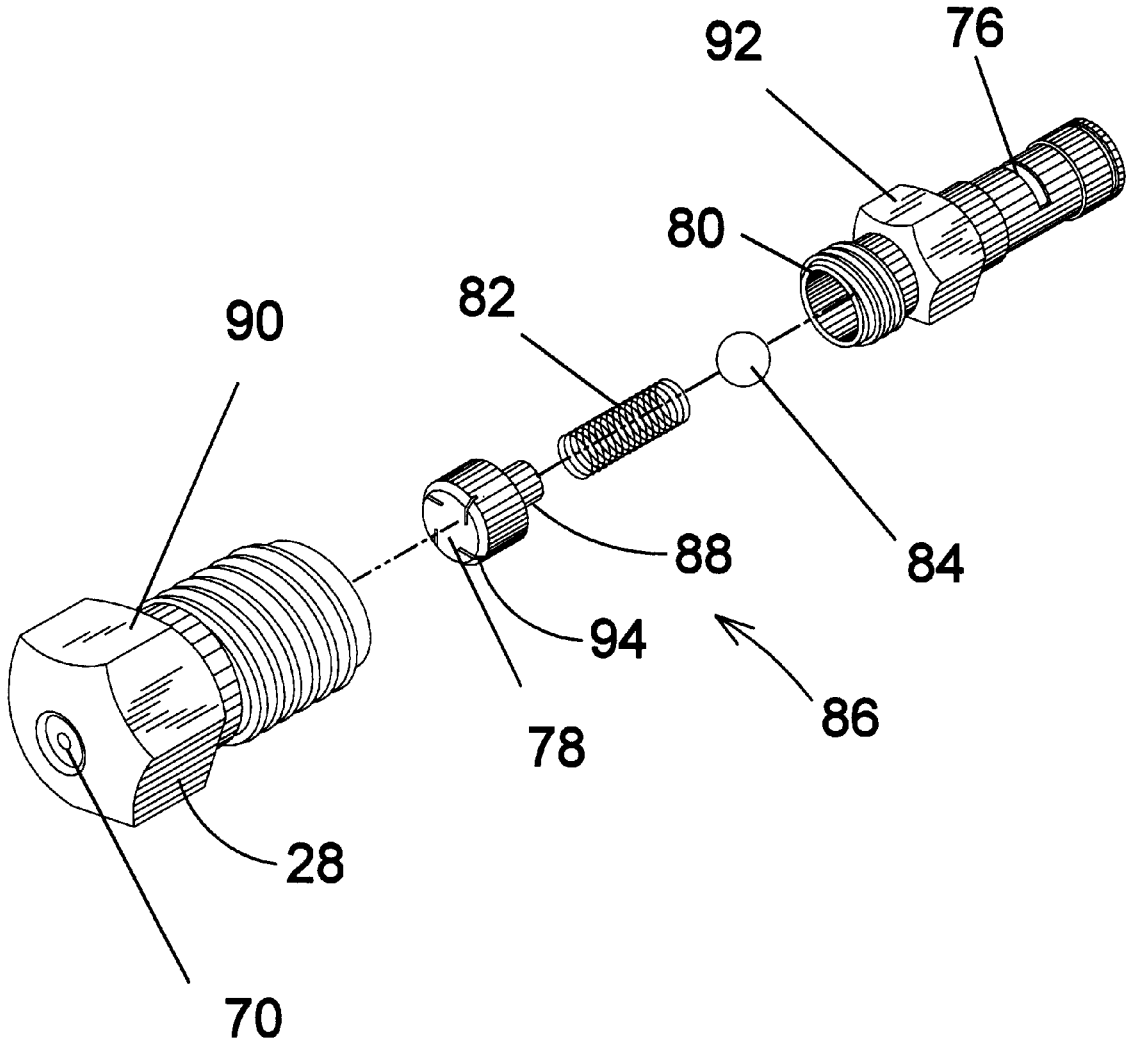
FIG. 9 is an exploded perspective view of an atomizer with a rotational nozzle and check valve assembly.

Turning to FIG. 9, shown therein is an exploded perspective view of an atomizer 28 having a rotational nozzle head 78 and check valve assembly. As previously disclosed, the fluid conduit contains a plurality of atomizers 28 strategically placed to provide a means of egress for the pressurized fluid during atomization and the resulting spray is ejected upon the object to be cooled such as a radiator or condensing coil. The emission from the atomizer 28 takes on a rotational effect due to the properties of a free-spinning rotational nozzle head 78 within the atomizer. The atomizer has a threaded two-piece, first 90 and second 92 housing with a central recess 80 and inlet conduit extending longitudinally therethrough and the inlet conduit leads to a fluid inlet recess 76 situated within the interior portion 80 of the conduit and an egress recess 70 on a distal end of the atomizer and in an exterior region of the conduit facing the component to be cooled thereby providing a passageway through which fluid can travel. The central recess 80 houses the atomization components comprising a spring 82 loaded ball-type 84 check valve and an atomizing rotational nozzle 86 having a cylindrical nozzle head 78 and a shank 88 being of sufficient diameter to nestle inside the spring 82 without restricting the potential for the axial rotation of the nozzle head 78. When the atomizer is assembled the nozzle head 78 is placed against the egress recess of the housing 90 with the shank 88 residing within a first end of the spring 82 and the ball 84 of the check valve held in place against the inlet conduit by a second end of the spring 82. The spring 82 exerts an opposing bias to the nozzle 86 and to the check ball 84. Fluid enters the atomizer through the inlet recess 76, passes through the inlet conduit where the flow into the central recess 80 is restricted by the ball 84 of the check valve which is of a greater diameter than the inlet conduit until the pressure within the conduit is greater than the bias presented by the spring 82 resulting in the ball 84 moving away from the inlet recess and compressing the spring 82 thereby increasing the bias applied to the nozzle 86 against the egress portion of the housing 90. Diagonally cut multiple channels 94 extend from the upper side portion of the nozzle head 78 to the top thereof providing the only path for the pressurized fluid to travel from the central recess to the egress recess. The pressure of the fluid passing through the channels 94 causes the propeller-like axial rotation of the nozzle head 78 resulting in a spiraling, atomized spray.

Figure 10:
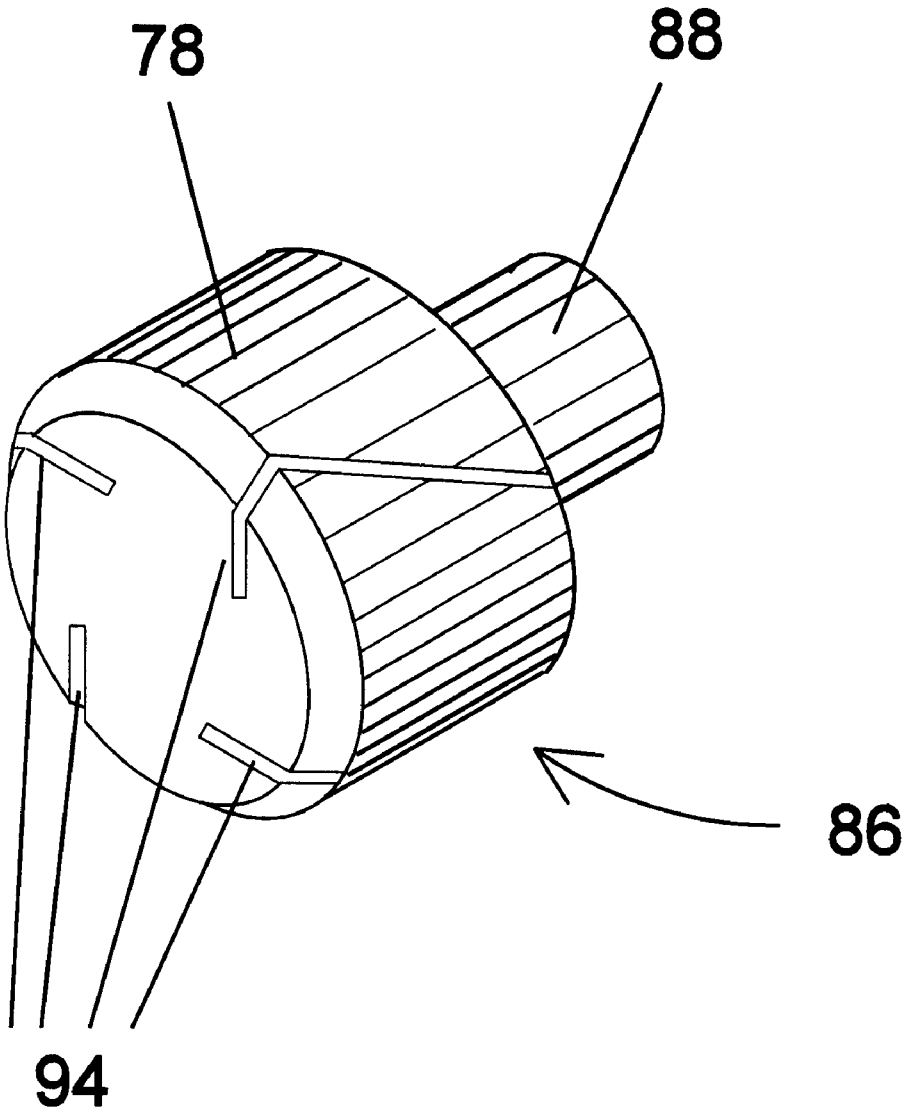
FIG. 10 is a perspective view of the rotational nozzle of the atomizer.

Turning to FIG. 10, shown therein is a perspective view of the rotational nozzle 86 of the atomizer. Diagonally cut multiple channels 94 extend from the upper side portion of the nozzle head 78 to the top thereof providing the only path for the pressurized fluid to travel from the central recess to the egress recess. The pressure of the fluid passing through the channels 94 causes the propeller-like axial rotation of the nozzle head 78 resulting in a spiraling, atomized spray. Shank 88 is also shown.

Figure 11:
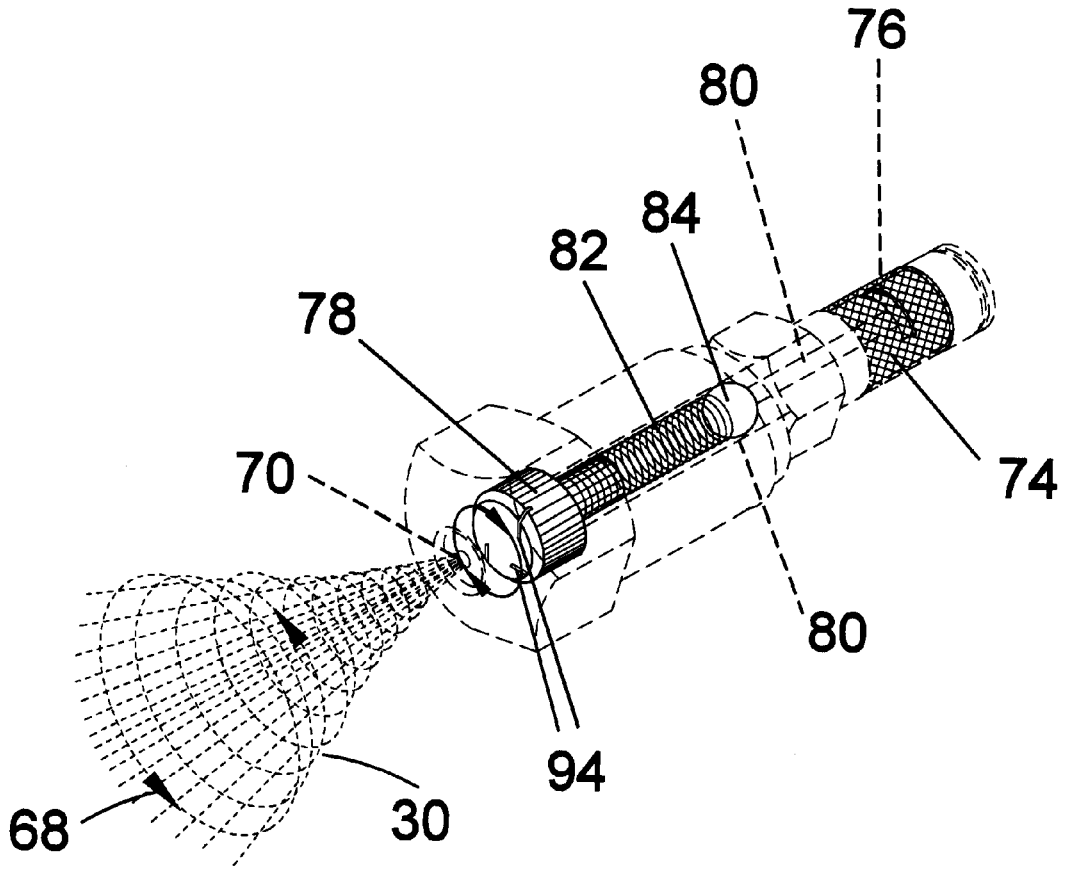
FIG. 11 is a perspective view of a rotational nozzle atomizer with the housing shown in hidden line to illustrate the internal workings of the atomizer during operation.

Turning to FIG. 11, shown therein is a perspective view of a rotational nozzle atomizer with the housing shown in hidden line to illustrate the internal workings of the atomizer during operation. Pressurized fluid enters the atomizer through inlet recess 76 and passes through the central recess or chamber 80 where the fluid is forced through the channels 94 of the nozzle head 78 so that the head 78 rotates the fluid prior to ejection through the outlet aperture 70. Spray 30 is also shown along with other elements previously described.

Figure 12:
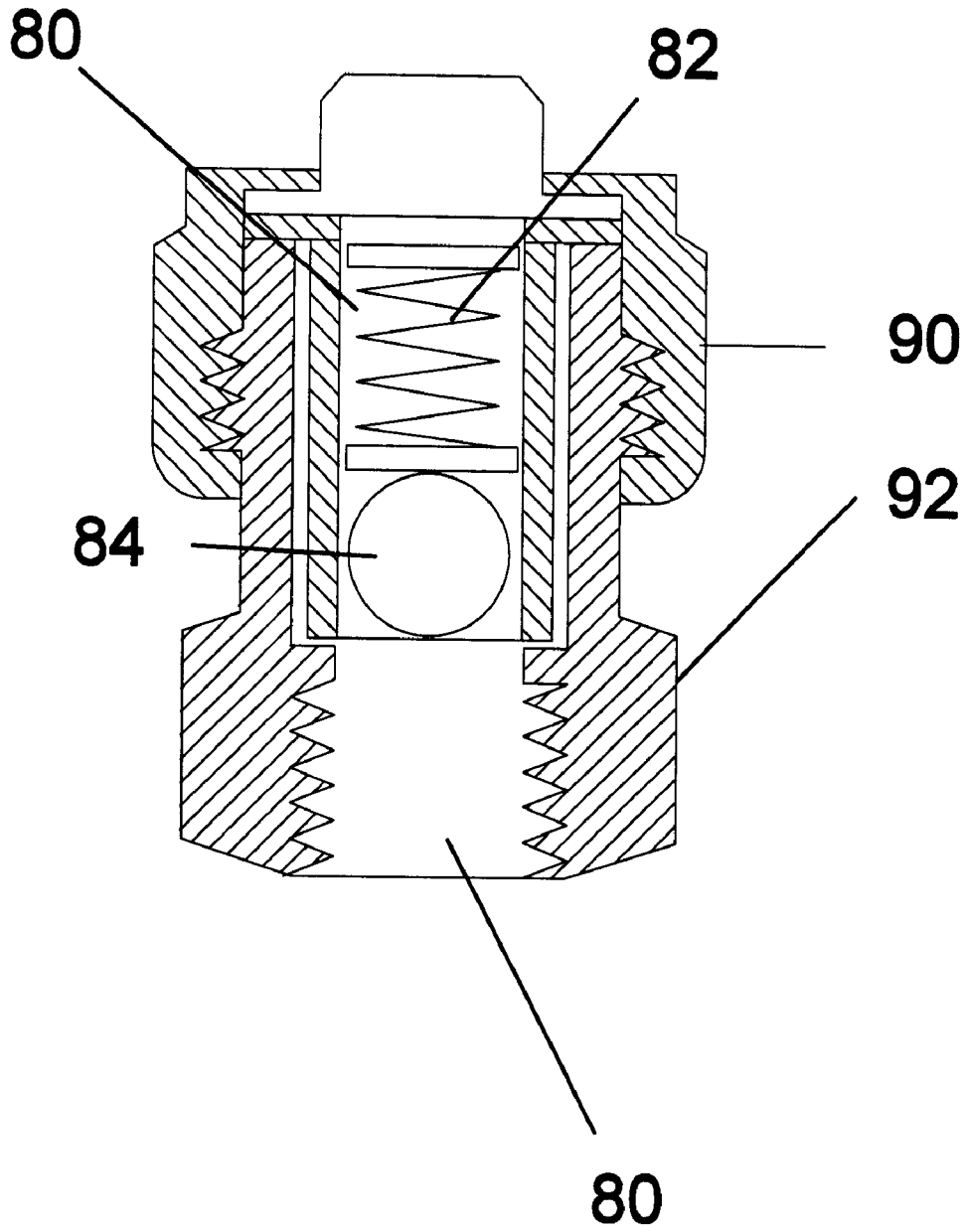
FIG. 12 is a cross-sectional side view of the atomizer assembly showing the check valve assembly.

Turning to FIG. 12, shown therein is a cross-sectional side view of the atomizer assembly showing the check valve assembly. Shown are the housing members 90, 92 along with the inlet conduit or central recess 80, spring 82 and ball 84 of the check valve assembly.

What is claimed to be new and desired to be protected by Letters Patent is set forth in the appended claims.

I claim:

1. A method for cooling and refilling a closed loop heat exchanger system, the heat exchanger system comprising a cooling coil containing fluid, comprising the steps of:

a) providing an auxiliary reservoir of cooling fluid compatible with the heat exchanger system;

b) detecting when cooling fluid is needed in the heat exchanger system;

c) refilling the heat exchanger system with cooling fluid from the auxiliary reservoir when needed;

d) detecting when the heat exchanger system is filled;

e) spraying the cooling coil of the heat exchanger system with cooling fluid from said auxiliary reservoir when needed; and, f) controlling said refilling of the heat exchanger system and said spraying of the cooling coil so that the system operates efficiently.

2. The method of claim 1, further comprising the step of rotating said spray so that the cooling coil is more efficiently cooled.

3. An apparatus for cooling and refilling a closed loop heat exchanger system, the heat exchanger system comprising a cooling coil containing fluid, comprising:

a) an auxiliary reservoir of cooling fluid compatible with the heat exchanger system;

b) means for detecting when cooling fluid is needed in the heat exchanger system;

c) means for refilling the heat exchanger system with cooling fluid from said auxiliary reservoir when needed;

d) means for detecting when the heat exchanger system is filled;

e) means for spraying the cooling coil of the heat exchanger system with cooling fluid from said auxiliary reservoir when needed; and, f) means for controlling said refilling of the heat exchanger system and said spraying of the cooling coil so that the system operates efficiently.

4. The apparatus of claim 3, further comprising means for rotating said spray so that the cooling coil is more efficiently cooled.

5. The apparatus of claim 3, wherein the heat exchanger system cooling coil further comprises a radiator.

6. The apparatus of claim 3, wherein the heat exchanger system cooling coil further comprises a multiple radiator.

7. The apparatus of claim 3, wherein the means for detecting when cooling fluid is needed in the heat exchanger system further comprises a thermocouple.

8. The apparatus of claim 3, wherein said thermocouple is disposed in the cooling coil of the heat exchanger system.

9. The apparatus of claim 3, wherein said means for refilling the heat exchanger system further comprises a pump disposed in a conduit connecting said auxiliary reservoir and the cooling coil.

10. The apparatus of claim 3, wherein said means for refilling the heat exchanger system further comprises a check valve disposed in a conduit connecting said auxiliary reservoir and the cooling coil.

11. The apparatus of claim 3, wherein said means for detecting when the heat exchanger system is filled further comprises a fill sensor disposed in the cooling coil.

12. The apparatus of claim 3, wherein said means for spraying the cooling coil further comprises multiple atomizers disposed in a spraying relationship to the cooling coil, said atomizers disposed at the end of an atomizer conduit connected to said pump.

13. The apparatus of claim 12, further comprising a solenoid valve disposed in said atomizer conduit, said solenoid controlling the flow of fluid in said atomizer conduit.

14. The apparatus of claim 3, wherein said means for controlling said refilling of the heat exchanger system further comprises a control valve for directing the flow of fluid from said auxiliary reservoir.

15. The apparatus of claim 14, further comprising a thermostat for controlling the set point temperature of said means for detecting when cooling fluid is needed in the heat exchanger system.

16. The apparatus of claim 15, further comprising a multiple position switch for controlling said thermostat; said switch proximately disposed to the operator of the heat exchanger system.

* * * * *